United States Patent [19]

Hess et al.

[11] Patent Number: 4,958,463

[45] Date of Patent: Sep. 25, 1990

[54] OPTICAL SURFACE QUALITY IMPROVING ARRANGEMENT

[75] Inventors: Arthur E. Hess, Palm Beach Gardens, Fla.; Gregory M. Sanger, New Fairfield, Conn.

[73] Assignee: United Technologies Corporation, Hartford, Conn.

[21] Appl. No.: 442,484

[22] Filed: Nov. 22, 1989

Related U.S. Application Data

[63] Continuation of Ser. No. 203,195, Jun. 6, 1988, abandoned.

[51] Int. Cl.[5] ..... B24B 7/00

[52] U.S. Cl. ..... 51/72 R; 51/90; 51/91 R; 51/206 R

[58] Field of Search ..... 51/72 R, 74 R, 90, 91 R, 51/165.77, 206 R

[56] References Cited

U.S. PATENT DOCUMENTS

| | | | |
|---|---|---|---|
| 233,067 | 10/1880 | Buzzell | 51/90 R |
| 1,758,534 | 5/1930 | Porter | 51/72 R |
| 2,850,848 | 9/1958 | Boltz | 51/74 R |
| 3,140,526 | 7/1964 | Tlamicha | 51/74 R |

FOREIGN PATENT DOCUMENTS

| | | | |
|---|---|---|---|
| 679616 | 2/1964 | Canada | 51/90 |
| 675695 | 2/1930 | France | 51/72 R |
| 29003 | of 1905 | United Kingdom | 51/72 R |

*Primary Examiner*—J. J. Hartman
*Attorney, Agent, or Firm*—Peter R. Ruzek

[57] ABSTRACT

An arrangement for controlledly removing material from an effective surface of a workpiece includes a mounting member which is mounted on a support for movement relative thereto at least in and opposite to a predetermined direction toward and away from the effective surface and a working member which is caused to rotate relative to the mounting member about a rotational axis that extends substantially normal to the predetermined direction. A pressing force acting in the predetermined direction is applied to the mounting member so that successive regions of an outer circumferential surface of the working member which is centered on the rotational axis act on a predetermined zone of the effective surface of the workpiece during the rotation of the working member with local pressures dependent on the magnitude of the pressing force and sufficient to remove material from the workpiece. The predetermined zone is caused to move over the effective surface, and at least one of the pressing force and the rate of such movement is so controlled that the material of the workpiece is removed from any area of the effective surface while the successive regions of the outer circumferential surface of the working member act thereon to such a depth that the effective surface obtains its desired configuration.

7 Claims, 3 Drawing Sheets

OPTICAL SURFACE QUALITY IMPROVING ARRANGEMENT

This application is a continuation of application Ser. No. 203,195, filed Jun. 6, 1988, now abandoned.

TECHNICAL FIELD

The present invention relates generally to arrangements for removing material from workpiece surfaces, and more particularly to an arrangement for improving the surface quality of optical components by removing material therefrom in a controlled fashion.

BACKGROUND ART

There are already known various arrangements for removing material from workpiece surfaces, either to give such surfaces their desired configurations in the first instance (such as by turning, milling or grinding), or to improve (such as by fine grinding, honing, polishing or lapping) the surface quality that has been originally obtained in some other way. Such surface quality improvement usually encompasses not only the smoothness of the surface in question, but also its conformity to the desired configuration.

One field of human endeavor in which it is particularly desirable if not mandatory to obtain a very high surface quality is the optical field where any surface irregularities or deviations from the desired surface contour, no matter how minute, would invariably adversely affect the quality of the light reflected or refracted at such a surface. Therefore, it is customary in the optical field to resort to a lapping and/or polishing operation as the last step in the manufacture of optical components.

All currently used optical polishing processes are based on the principle of wear in that usually a polishing compound consisting of fine particles, for instance, metal oxide particles, which are mixed with a liquid carrier is introduced between the optical surface to be polished and some kind of a lapping material. Classically, such optical polishing has been carried out using pitch lap elements constructed of or carrying wood rosin or coal tar pitches, into which the particles contained in the polishing compound can be embedded as a function of time during the actual polishing process. After the introduction of the polishing compound, the pitch lap element which consists of or is provided with the lapping material is pressed with a constant pressing force against the optical surface to be polished or otherwise treated and is then caused to move in a series of oscillating translatory and/or rotating motions over the optical surface. As this occurs, the polishing particles that have become embedded in the lapping material, in turn, remove material from the optical surface due to a currently not well understood combination of mechanical abrasion, thermal flow and chemical attack.

This relatively unsophisticated approach employing a constant pressing force works reasonably well when the surfaces to be treated are planar or have another relatively simple geometry, such as spherical. This is so because the surface of the lap element that is juxtaposed with the region of the surface being treated can be relatively easily conformed to the desired configuration of the surface being treated and it then exerts different local pressures on different points of this region, the magnitude of each such local pressure being dependent on the extent of deviation of the affected point from its desired location, so that material is removed from more elevated points of the optical surface being treated much more rapidly than from less elevated points, until the differences between the peaks and valleys of the optical surface are either eliminated or reduced to an acceptable value. Thus, ideally, this approach should improve not only the RMS (root mean square) roughness of the affected surface, but also the conformity of such surface to its desired shape.

However, experience has shown that even under these relatively simple circumstances the final quality of the thus treated surface, and especially the conformity of such surface to its desired overall configuration, leaves much to be desired. One of the reasons for this less than ideal situation is that, in the equation which is widely believed to govern the polishing process and which postulates that the amount of material removed at any point of the optical surface is proportional to a proportionality constant times the local pressure at that point times the instantaneous velocity of the lapping surface over the surface being polished, the proportionality constant is actually a variable which is a complex combination of some forty-three parameters, some of which are the lap wear, viscosity changes, temperature changes, particle size distribution, particle chemistry, and others. Inasmuch as many of these parameters can change constantly and unpredictably not only as the polishing operation proceeds but also from one point of the surface being treated to another, it is very difficult if not impossible, to choose the pressing force in such a manner as to achieve a predictable wear of the material from the surface being polished under all conditions, even when the effected surface has a relatively simple configuration, such as one of those mentioned above. Obviously, this problem is further exacerbated when the surface to be polished has or is to obtain a more complex configuration.

A relatively recent development in the age-old art of optical polishing is the use of computer numerically controlled (CNC) machines. Such machines render it possible not only to smooth or polish the surface in question, but also to improve its conformity to the desired overall shape, be it planar, spherical, or curved in any other manner. This is accomplished by removing material from the surface being treated to different depths at different regions of such surface. This shaping or figuring of the optical surface, as it is often called, is normally accomplished by comparing the actual shape of the optical surface as it exists prior to the polishing operation with the desired final shape of the optical surface. By using the difference between these two values for any point on the optical surface as an indication of the amount of material to be removed, it is possible to achieve the desired overall shape of the optical surface. Such a polishing machine then uses this difference function as the primary input information for determining paths and dwell times for the polishing lap. Typically, an embedded computer model of the CNC machine convolves the wear function of the polishing lap with the aforementioned difference function to determine, for example, the required dwell times and velocities.

The above-discussed pitch laps have been applied to computer controlled surfacing, but only with moderate success because the wear rate of such pitch laps changes constantly with time and temperature. In addition, the quality of the optical surface, that is, the RMS roughness and the resultant scatter pattern, changes as a function of time. Unfortunately, when using the conventional pitch laps, the changes in the pitch lap performance are not easily predicted, nor are they easily made repeatable so that they could be programmed into the computer and compensated for by the associated control system of the CNC machine. The end result of this is that computer numerically controlled polishing, as practiced heretofore, could predict or control the final shape to no better than five percent. While this may be acceptable since these errors may be reduced by using a number of iterative runs, such a process is slow, time consuming and costly.

Accordingly, it is a general object of the present invention to avoid the disadvantages of the prior art.

More particularly, it is an object of the present invention to provide an arrangement for improving the surface quality (shape and finish) especially of optical surfaces, which arrangement does not possess the disadvantages of the known arrangements of this kind.

Still another object of the present invention is to develop the arrangement of the type here under consideration in such a manner as to achieve accuracy, predictability and repeatability in the shaping and smoothening of the affected surface.

It is yet another object of the present invention to devise an arrangement of the above type which would render it possible to accomplish the material-removal operation in a very expeditious manner.

A concomitant object of the present invention is design the arrangement of the above type in such a manner as to be relatively simple in construction, inexpensive to manufacture, easy to use, and yet reliable in operation.

DISCLOSURE OF THE INVENTION

In keeping with these objects and others which will become apparent hereafter, one feature of the present invention resides in an arrangement for controlled removal of material from the surface of a workpiece. According to the invention, this arrangement comprises a mounting member mounted on a support for movement relative thereto at least in and opposite to a predetermined direction toward and away from the surface; a working member attached to the mounting member for rotation about a rotational axis that extends substantially normal to the predetermined direction, and having an outer circumferential surface that is centered on the rotational axis; and means for rotating the working member about the rotational axis. The arrangement of the present invention further includes means for applying to the working member a pressing force acting in the predetermined direction so that successive regions of the outer circumferential surface of the working member act on a predetermined zone of the surface of the workpiece during the rotation of the working member with local pressures dependent on the magnitude of the pressing force and sufficient to remove material from the workpiece; means for effecting relative movement between the support and the workpiece with attendant movement of the predetermined zone over the effective surface; and means for so controlling at least one of the applying and effecting means that the material of the workpiece is removed from any area of the effective surface while the successive regions of the outer circumferential surface of the working member act thereon to such a depth that the effective surface obtains its desired configuration.

A particular advantage of the arrangement as described so far is that the successive regions of the outer circumferential surface of the working member can move with respect to the affected zone of the surface being treated at a relatively high speed, thus causing a vigorous material-removing action, while at the same time, because of the relatively small area of the affected zone, the action of the applying and/or the effecting means can be easily controlled by the controlling means in such a manner as to achieve the precise depth of material removal from the affected zone in accordance with need, even if such desired depth varies significantly from one such zone to another.

It is particularly advantageous when, in addition to the rotation about its own rotational axis, the working member is caused to turn, jointly with the mounting member, about a turning axis which is substantially parallel to the direction of application of the pressing force, that is, substantially normal to the direction of the rotational axis. In this manner, there is obtained, in essence, point symmetry in the material-removing operation as far as the affected zone of the surface being treated is concerned.

According to another aspect of the invention, the outer circumferential surface of the working member has a generatrix following an arcuate course prior to deformation, particularly such that the outer circumferential surface of the working member has either a barrel-shaped or a spherical configuration. This expedient results in a distribution of the local pressures exerted by the working member that is easy to convolve with the aforementioned difference function.

BRIEF DESCRIPTION OF THE DRAWING

The present invention will be described in more detail below with reference to the accompanying drawing in which.

BEST MODE FOR CARRYING OUT THE INVENTION

Figure 1:
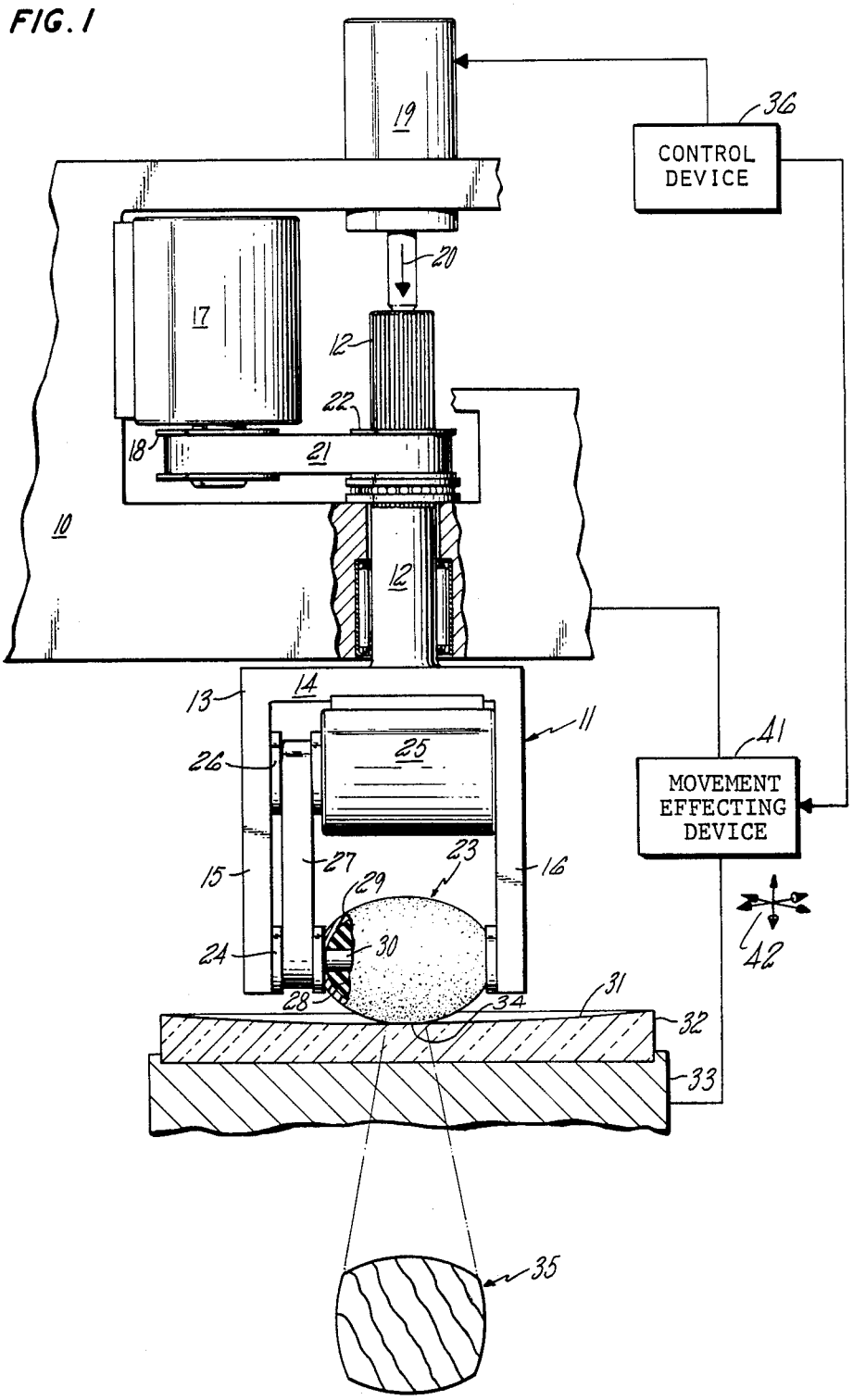
FIG. 1 is a somewhat simplified side elevational view of a surface quality improving arrangement according to the present invention as used to treat a surface of an optical component.

Referring now to the drawing in detail, and first to FIG. 1 thereof, it may be seen that the reference numeral 10 has been used therein to identify a support of an exemplary implementation of the surface quality improvement arrangement of the present invention. A mounting member 11 including a shaft 12 and a bifurcated mounting frame 13 is mounted on the support 10 for turning about a turning axis which is shown in the drawing to extend substantially vertically. The mounting frame 13 includes a connecting portion 14 that is secured to or integral with the shaft 12 and extends substantially normal to the aforementioned turning axis, and two arms 15 and 16 which are secured to or integral with the connecting portion 14 and extend substantially parallel to one another and to the turning axis.

The support 10 further carries a turning motor 17 shown to have a driving pulley 18, and an actuator 19 which is operative, in any known manner, for exerting an axial pressing force on the shaft 12 as indicated by an arrow 20, and for axially moving the mounting member 11 in and/or opposite to the arrow 20. An endless transmission element 21, such as a transmission belt, is shown to be trained about the driving pulley 18 of the turning motor 17 and about a driven pulley 22 which is provided on or connected to the shaft 12 for joint turning therewith about the turning axis. Thus, rotation of the driving pulley 18 caused by the turning motor 17 will result in proportionate turning of the driven pulley 22 and thus of the shaft 12 and the mounting frame 13, as well as of all components mounted on the mounting frame 13, about the turning axis.

The components mounted on the mounting frame 13 for joint turning therewith include a working member 23 mounted between the arms 15 and 16 of the mounting frame 13 for rotation about a rotational axis which is substantially perpendicular to the aforementioned turning axis, another driven pulley 24 centered on the rotational axis and connected with the working member 23 for joint rotation about the rotational axis, a driving motor 25 having another driving pulley 26 which rotates about an axis parallel to the rotational axis of the working member when the driving motor 25 is energized, and another endless transmission element 27, such as a transmission belt, which is trained about the pulleys 24 and 26 and thus causes the driven pulley 24 and thus the working member 23 to rotate about the rotational axis at an angular speed that is proportional to that of the driving pulley 26. The driving motor 25 is supplied with electric energy in any well known manner which has not been indicated in the drawing in order not to unduly encumber the same.

It is currently contemplated to make of rotation of the working member 23 about its rotational axis, and the speed of turning of the mounting member 11 with the components mounted thereon about the turning axis, independently variable, so that the polishing rates and specific characteristics of the working member 23 can be chosen in such a manner as to produce the desired wear pattern. This may be achieved, for instance, by making the speeds of rotation of the motors 17 and 27 independently variable, or by selecting the desired transmission ratios between the turning motor 17 and the mounting member 11, on the one hand, and between the motor 25 and the working member 23, in the desired manner.

The working member 23 is shown to include a core or body 28 of a compliant or elastically yieldable material, and an outer layer or sheath 29 of a material which is at least flexible and has a good wear resistance. The body 28 is mounted for joint rotation on a shaft 30 which, in turn, is connected to or of one piece with the driven pulley 24 to rotate with the pulley 24 about the rotational axis of the working member 23. The outer layer 29 circumferentially surrounds at least a portion of the outer periphery of the body 28 and is shown to surround the entire periphery of the body 28. The body 28 may be made of any number of soft relatively compliant materials, such as open or closed cell polyurethane foams. Specific materials that are currently contemplated for the body 28 of the working member 23 include ECCOGEL COMPOUND 1365 TM, BUNA-N TM or ETHAFOAM TM. The outer layer 29 of the working member 23 may be made of any number of other relatively compliant or at least flexible materials which preferably exhibit a relatively high wear resistance; such materials include, for instance, PELLON TM, POLYTRON TM or Moyco Industries ULTRALAP TM. The outer layer 29 is attached to the body 28, for instance by any of the well known adhesives that are capable of forming a permanent bond between the materials of the body 28 and of the outer layer 29.

It may also be ascertained from FIG. 1 of the drawing how the above-described surface quality improving arrangement of the present invention is to be used for improving the quality of an optical surface 31 of an optical component 32 which is supported on and held at least during the operation of the above arrangement by an only diagrammatically indicated holding support 33. The support 10 and the holding support 33 are movable relative to one another in such a manner that the working member 23 can first be positioned over the desired initial zone of the optical surface 31, and then moved toward the surface 31 either by or independently of the action of the actuator 19. Then, after the pressing force has been applied by the actuator 19 to the mounting member 11 and via the latter to the working member 23, with attendant deformation of a portion 34 of the working member 2 in substantial conformity with the juxtaposed zone of the surface 31, the support 10 and the holding support 33 are moved relative to one another in such a manner during the actual operation of the surface quality improving arrangement that the location of the deformed portion 34 of the working member 23 on the surface 31 gradually changes, with attendant corresponding change in the position of the affected zone on the surface 31, until the affected zones have covered the entire area of the surface 31 being treated.

This means that the support 10 and the holding support 33 have to be capable of moving relative to one another, as indicated by an arrow cluster 42, another at least from left to right and/or vice versa, and from front to back and/or vice versa, and possibly also vertically, as considered in FIG. 1 of the drawing, and have to be actually moved relative to each other in one or more of these directions at least during some phases of the positioning and treating operations. Any desired one or more of such movements is effected by means of a diagrammatically illustrated movement effecting device 41 of any well-known construction.

As mentioned before, the actuator 19 exerts a predetermined axial force through the shaft 12 on the mounting member 11 and thus on the working member 23 at least during the material-removing or similar treating operation, thus deforming the portion 34 of the working member 23 which, in turn, produces on the surface 31 a "footprint" which is shown at an enlarged scale at 35. Obviously, as the working member 23 rotates about its rotational axis, the location of the deformed portion 34 in space remains the same (assuming that the support 10 is stationary) but the position of the deformed portion 34 as considered with respect to the working member 23 orbits the axis of the latter; in other words, circumferentially adjacent regions of the working member 23 successively become the deformed portion 34. In addition, the turning of the mounting member 11 about its turning axis results in gradual changes in the orientation or angular position of the footprint 35 about the turning axis, and the aforementioned relative movement between the support 10 and the holding support 33 in the course of the treating operation brings about a gradual change in the location of the footprint 35 on the surface 31 being treated.

The magnitude of the pressing force exerted by the actuator 19 on the mounting member 11 is controlled by a control device 36 which may also additionally control the relative movement of the support 10 and the holding support 33 and other operating functions of the optical surface quality improving arrangement described above, in a well known manner.

It will be appreciated that the depth of material removal from the affected surface 31 of the component 32 will depend not only on the dwell time of the compressed portion 34 of the working member 23 at any particular zone of the surface 31 and on the magnitude of the pressing force, but also on the distribution of the local pressures resulting from the pressing force between the deformed portion 34 of the working member 23 and the affected zone of the surface 31 over the area of the footprint 35.

As mentioned before, the removal rate of material from the surface 31, is dependent on the pressing force and on the speed of relative movement between the outer periphery of the working member 23 and the surface 31. This dependency may be expressed for each infinitesimally small locality of the footprint 35 as an equation $$dH/dt = K \cdot p \cdot dS/dt$$

wherein dH/dt is the local material removal rate,

K is a constant (which, however, as mentioned before, may vary in dependence on various operating parameters), p is the local pressure, and dS/dt is the local relative velocity.

As also mentioned before, an embedded computer model of the material-removal operation, which may be incorporated in the control device 36, convolves the wear function of the working member 23 with the difference function (i.e. the amount of material to be removed from the surface 31 at any particular location as determined by measuring the deviation of the actual position of this location prior to the surface quality improving operation from its desired location) to determine at least the dwell times and velocities, if not the magnitude of the pressing force. Perhaps the easiest function to convolve with the difference function is a Gaussian wear function.

Figure 2:
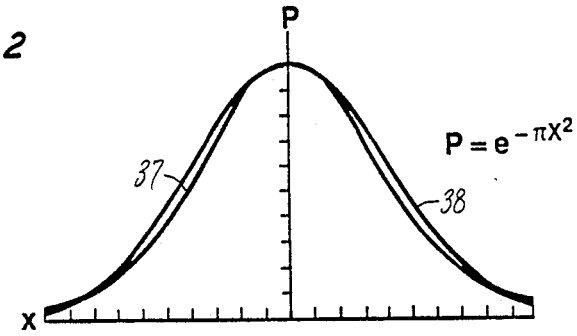
FIG. 2 is a graphic representation of a wear function of the arrangement of FIG. 1 in comparison with a Gaussian probability distribution function.

In this respect, it is currently preferred to select the material of the core 28 in such a manner that its compressibility is consistent with the surface departures from a plane, and to choose the barrel-shaped configuration for the working member 23 of FIG. 1, in such a manner that the combination of these two measures results in the desired basically Gaussian distribution of the local pressures over the area of the footprint 35. This result is illustrated in FIG. 2 of the drawing in which the curve 37 indicates the actual local pressure distribution when the working member 23 has the properly selected barrel-shaped configuration in accordance with FIG. 1 of the drawing, whereas the curve 38 is a corresponding indication of the desired Gaussian curve of normal probability distribution, with the scales on both the ordinate and the abscissa being expressed in relative and thus unitless terms.

Figure 3:
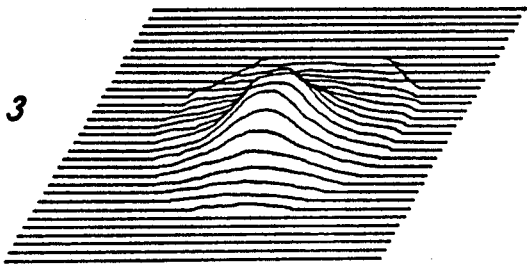
FIG. 3 is a map showing a three-dimensional wear function distribution of the arrangement of FIG. 1.

FIG. 3 depicts a three-dimensional, perspective map of the actual local pressure distribution over the area of the affected zone of the surface 31 as obtained by pressing the working member 23 against a predetermined zone of the surface 31 without affecting movement of this zone relative to the surface 31, by causing the working member 23 to rotate about its rotational axis and turn about the turning axis, by measuring the resulting depression, and by inverting the results such that the highest elevations on the map are indicative of the deepest depths at the surface 31. It may be seen that the use of the barrel-shaped working member 23 of FIG. 1 results in a two-dimensional or rotationally symmetrical Gaussian wear function. It is evident from the above that it is possible to predict what the wear function should be, and that the actual absolute shape of the wear function is in fact Gaussian as desired. In this manner, the wear rate, the wear footprint, and the temporal dependence are rendered consistent, predictable and repeatable.

Figure 4:
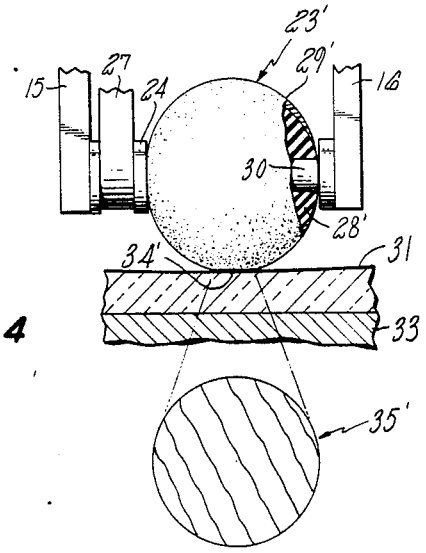
FIG. 4 is a view corresponding to that of FIG. 1 but showing only a modified portion of the arrangement.

FIG. 4 of the drawing depicts a somewhat modified construction of a portion of the surface quality improving arrangement of the present invention. The same reference numerals as before have been used to identify the same parts, and reference numerals supplemented with a prime have been used for parts which correspond to but differ in some respects from the parts described above that have corresponding reference numerals. It may be seen that the shape of the working member 23' of FIG. 4 is substantially spherical rather than barrel-shaped, which is at least primarily attributable to a spherical configuration of the body or core 28', while the outer layer 29' may have a constant thickness throughout, or its thickness may diminish in axial directions away from the center and thus from the deformed portion 34', as indicated in FIG. 4. As a result of the spherical shape of the working member 23', the footprint 35' has a substantially circular shape.

A particular advantage especially of the spherical shape of the working member 23' of FIG. 4, which advantage is particularly pronounced when the surface whose quality is to be improved is a spherical, is that, in contradistinction to conventional lapping techniques, it is no longer necessary to control the operation of the surface quality improving arrangement in such a manner that the pressing force is applied under all circumstances in a direction normal to the plane instantaneously tangential to the surface 31 at the center of the footprint such as 35'. As a matter of fact, as may be ascertained from the diagrammatic simplified illustration of FIG. 5 of the drawing in which the same reference numerals as before have been used to identify the same parts, the working member 23' presents, as it is pressed by the pressing force P against the complex surface 31 of the substrate or component 32 at any number of angles within a range of, for instance, 15°, the same or substantially the same footprint 35' to the surface 31. The change in the footprint 35' and the absolute value of the pressing force P are simple cosine functions of the angle between the normal to the surface 31 at the center of the wear pattern and the normal that coincides with or is parallel to the aforementioned turning axis. The advantage lies in the fact that, when using the working member such as 23', the CNC machine can have the number of computer numerically controlled axes reduced from five to three. In other words, it is no longer necessary to have the polishing or similar head tiltable in two planes so that the lapping material is always applied in a direction normal to the ever curving contour of the surface 31; rather, it is sufficient to merely control the magnitude of the pressing force P by multiplying it by an inverse of the cosine of the instantaneous value of the aforementioned angle. This greatly reduces the complexity and cost of the machine as well as increases the speed of the processor, such as the control device 36, which controls the operation of the machine. This, in turn, contributes to efficiency in the operation of the machine in terms of cost and time or productivity.

Figure 5:
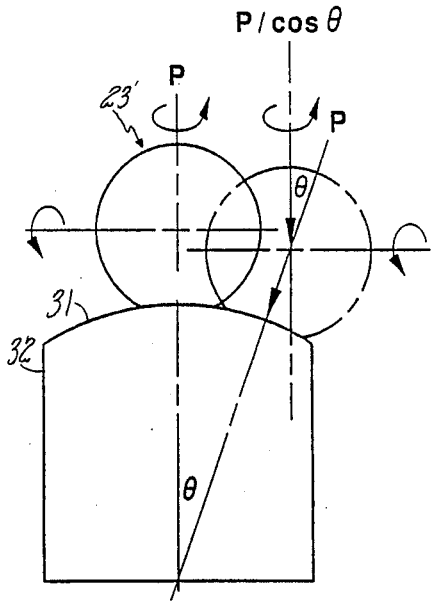
FIG. 5 is a diagrammatic simplified view illustrating the conditions prevailing when the arrangement modified in accordance with FIG. 4 is applied to a surface having a substantial curvature.
Figure 6:
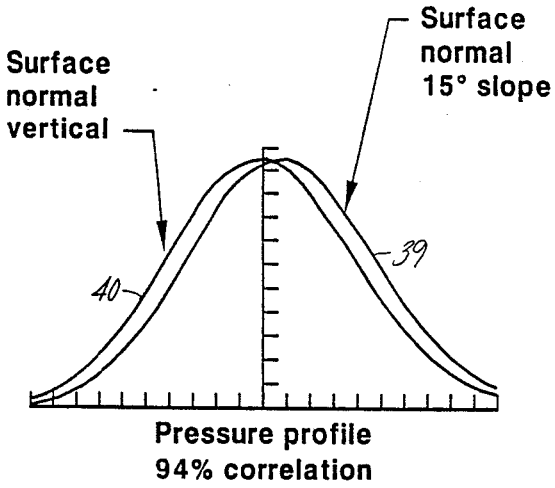
FIG. 6 is a graphic representation similar that of FIG. 2 but showing the effect of a change in the approach angle in accordance with FIG. 5 on the wear distribution curve.

FIG. 6 of the drawing illustrates that, a curve 39 which is representative of the wear function for the value of the aforementioned angle amounting to 15°, for instance, that is, for the operation at a surface zone that has a slope of about 15° relative to the horizontal as considered in FIG. 5 of the drawing, is slightly shifted relative to a curve 40 which is representative of operation at 0° angle and slope. However, the shapes of the curves 39 and 40 are substantially identical so that the relative shift can be easily taken into consideration by the control device 36 of FIG. 1 when determining the operating parameters of the machine.

The surface quality improving arrangement of the present invention has numerous advantages as compared to the heretofore used arrangements of this type. In addition to the advantages already mentioned before, another advantage; the use of the technique disclosed herein resides in the fact that the working member 23 or 23' of the present invention provides a time invariant, predictable and repeatable polishing or similar material-removing function and that it lends itself nearly ideally to computer numerically controlled polishing or the like, so that the final optical figuring process on precision optics can be achieved much faster and at far lower cost than with currently existing pitch lapping techniques.

Moreover, because the working member 23 or 23' utilizes urethane foam or other synthetic plastic material rather than pitch, its pressure distribution over the area of the footprint 35 or 35' is constant as a function of time. Also, because of the geometry of the working member 23 or 23', very high lapping speeds are obtainable. These high lapping speeds allow the removal of the material from the surface 31 being treated at a very rapid rate of removal. The high speed of removal reduces the total treating time necessary for achieving the final optical surface configuration and thus results in a very efficient and low-cost polishing operation.

Because the working member 23 or 23' does not employ pitch, it is relatively insensitive to approach angle on the optical surface and insensitive to temperature variations. The approach proposed in accordance with the present invention also reduces and in some instances eliminates many of the time and temperature dependencies inherent in the classical pitch laps. The cumulative result of these advantages is that the working member 23 or 23' of the present invention achieves a predictability of less than one percent total error.

While the present invention has been illustrated and described as embodied in a particular construction of a surface quality improving arrangement, it will be appreciated that the present invention is not limited to this particular example; rather, the scope of protection of the present invention is to be determined solely from the attached claims.

We claim:

1. An arrangement for controlledly removing material from an effective surface of a workpiece, comprising a support;

a mounting member mounted on said support for movement relative thereto at least in a predetermined direction toward, and opposite to said predetermined direction away from, the effective surface;

a working member mounted on said mounting member for rotation about a rotational axis that extends substantially normal to said predetermined direction, and having an outer circumferential surface that is centered on said rotational axis;

means for rotating said working member about said rotational axis relative to said mounting member;

means for applying to said working member a pressing force acting in said predetermined direction relative to said support so that successive regions of said outer circumferential surface of said working member act on respective infinitesimally small localities of a predetermined zone of the effective surface of the workpiece during the rotation of said working member with respective local pressures dependent on the magnitude of said pressing force and sufficient to remove material from the workpiece;

means for effecting relative movement between said mounting member and the workpiece at least along a plane normal to said predetermined direction with attendant movement of the predetermined zone over the effective surface; and means for controlling said applying and effecting means, including means for so varying, while said working member is in continuous material-removing contact with the effective surface, at least one of said pressing force applied by said applying means and a speed of said relative movement effected by said effecting means in dependence on the instantaneous position of said predetermined zone on said effective surface that, wherein said working member has at least a portion situated immediately within said outer circumferential surface and being elastically deformable, to be deformed when said applying means applies said pressing force to said mounting member so that said outer circumferential surface of said working member is in area contact with the predetermined zone of the effective surface of the workpiece, and wherein said outer circumferential surface of said working member follows an arcuate course as considered axially of said working member prior to deformation, such said successive regions of said outer circumferential surface of said working member remove the material of the workpiece from different areas of the effective surface to such different depths as needed to bring the effective surface to its desired configuration.

2. The arrangement as defined in claim 1, wherein said mounting member is additionally mounted on said support for turning about a turning axis that is substantially parallel to said predetermined direction; and further comprising means for turning said mounting member relative to said support at a predetermined angular velocity about said turning axis.

3. The arrangement as defined in claim 1, wherein said elastically deformable portion of said working member includes a backing body of a compliant material having an outer periphery, and a working layer of a flexible, highly wear-resistant material secured to and covering at least said outer periphery of said backing body and having said outer circumferential surface.

4. The arrangement as defined in claim 1, wherein said outer circumferential surface of said working member has a substantially spherical configuration prior to deformation.

5. The arrangement as defined in claim 1, wherein said outer circumferential surface of said working member has such a substantially spherical configuration prior to deformation.

6. The arrangement as defined in claim 1, wherein said outer circumferential surface of said working member has such a configuration prior to deformation that said local pressures encountered after deformation have a substantially Gaussian distribution over the predetermined zone of the effective surface.

7. The arrangement as defined in claim 1, wherein said controlling means controls said pressing force of said applying means.

* * * * *

UNITED STATES PATENT AND TRADEMARK OFFICE

CERTIFICATE OF CORRECTION

PATENT NO. : 4,958,463

DATED : September 25, 1990

INVENTOR(S) : Arthur E. Hess et al

It is certified that error appears in the above-identified patent and that said Letters Patent is hereby corrected as shown below:

Claim 4, Column 11, Line 8: after "substantially" delete "spherical" and insert --barrel-shaped--.

Signed and Sealed this

Ninth Day of June, 1992

*Attest:*

DOUGLAS B. COMER

*Attesting Officer*

*Acting Commissioner of Patents and Trademarks*